US005897148A

United States Patent [19]

Arabia, Jr. et al.

[11] Patent Number: 5,897,148

[45] Date of Patent: Apr. 27, 1999

[54] CATCH FOR DOOR LATCH DETENT LEVER

[75] Inventors: Frank Joseph Arabia, Jr., Macomb Township; Donald Michael Perkins, Clarkston, both of Mich.

[73] Assignee: General Motors Corporation, Detroit, Mich.

[21] Appl. No.: 08/929,455

[22] Filed: Sep. 15, 1997

[51] Int. Cl.[6] ..... E05C 3/06

[52] U.S. Cl. ..... 292/216; 292/209; 292/DIG. 23; 292/DIG. 61; 292/DIG. 65; 292/334

[58] Field of Search ..... 292/216, 169.11, 292/169.14, 335, 107, 225, 152, DIG. 23, DIG. 61, DIG. 38, DIG. 65, 209, 334

[56] References Cited

U.S. PATENT DOCUMENTS

| | | | |
|---|---|---|---|
| 4,538,845 | 9/1985 | Yamada | 292/216 |
| 4,971,373 | 11/1990 | Hamada et al. | 292/216 |
| 5,188,406 | 2/1993 | Sterzenbach et al. | 292/216 |
| 5,544,925 | 8/1996 | Ikeda | 292/216 |

*Primary Examiner*—Darnell M. Boucher
*Assistant Examiner*—Clifford B. Vaterlaus
*Attorney, Agent, or Firm*—Charles E. Leahy

[57] ABSTRACT

A door latch for latching the vehicle door in the closed position includes a fork bolt pivotally mounted on the latch housing for movement between the latching position engaging a striker in an unlatching position to unlatch from the striker and permit opening of the door. A detent lever is pivotally mounted on the latch housing for movement between an engaging position engaging the fork bolt in its latching position and a disengaging position disengaged from the fork bolt to permit pivoting of the fork bolt to its unlatching position. A spring acts between the detent lever and the latch housing to urge the detent lever to the engaged position. A catch member is provided to retain the detent lever in the disengaged position and block pivoting movement of the detent member to the engaging position in response to absence of the spring. The catch member is preferably provided by a plastic housing carried by the door latch and having a catch member integrally molded therewith and having an integral sensing arm normally engaging with the detent spring to establish the catch member in its releasing position. The catch member is self-biased into sensing contact with the detent spring so that absence of the spring enables the catch member to move to the catching position in which a hook is provided on the catch member which engages with the detent lever.

2 Claims, 1 Drawing Sheet

CATCH FOR DOOR LATCH DETENT LEVER

TECHNICAL FIELD

This invention relates to a door latch and more particularly provides a catch member adapted to retain the detent lever in a position disengaged from the fork bolt in response to absence of the detent lever bias spring.

BACKGROUND OF THE INVENTION

It is well known in motor vehicles to provide a door latch for latching the vehicle door in the closed position. A door latch typically includes a housing on which a fork bolt is pivotally mounted to engage and disengage a striker mounted on the vehicle body. A detent lever is pivotally mounted on the housing for movement between an engaged position engaging the fork bolt and a disengaging position disengaged from the fork bolt. A spring bias acts between the housing and the detent lever to urge the detent lever to the engaged position engaging the fork bolt.

SUMMARY OF THE INVENTION

The present invention provides a catch member which retains the detent lever in the disengaged position and blocks pivoting of the detent member to the engaging position in response to a sensed absence of the detent lever bias spring from the door latch.

More particularly, according to the invention, a door latch for latching the vehicle door in the closed position includes a fork bolt pivotally mounted on a latch housing for movement between a latching position engaging a striker and an unlatching position to unlatch from the striker and permit opening of the door. A detent lever is pivotally mounted on the latch housing for movement between an engaging position engaging the fork bolt in its latching position and a disengaging position disengaged from the fork bolt to permit pivoting of the fork bolt to its unlatching position. A spring bias acts between the detent lever and the latch housing to urge the detent lever to the engaged position. A catch member is provided to retain the detent lever in the disengaged position and block pivoting movement of the detent member to the engaging position in response to absence of the spring. The catch member is preferably provided by a plastic housing carried by the latch housing and having a catch member integrally molded thereto and having an integral sensing arm normally engaging with the detent spring to establish the catch member in its releasing position. The catch member is self-biased into sensing contact with the detent spring so that absence of the spring enables the catch member to be in a catching position in which a hook provided on the catch member engages with the detent lever.

BRIEF DESCRIPTION OF THE DRAWINGS

These and other features and advantages of the invention will become apparent upon consideration of the Description of the Preferred Embodiment and in the appended drawings in which.

DESCRIPTION OF THE PREFERRED EMBODIMENT

Figure 1:
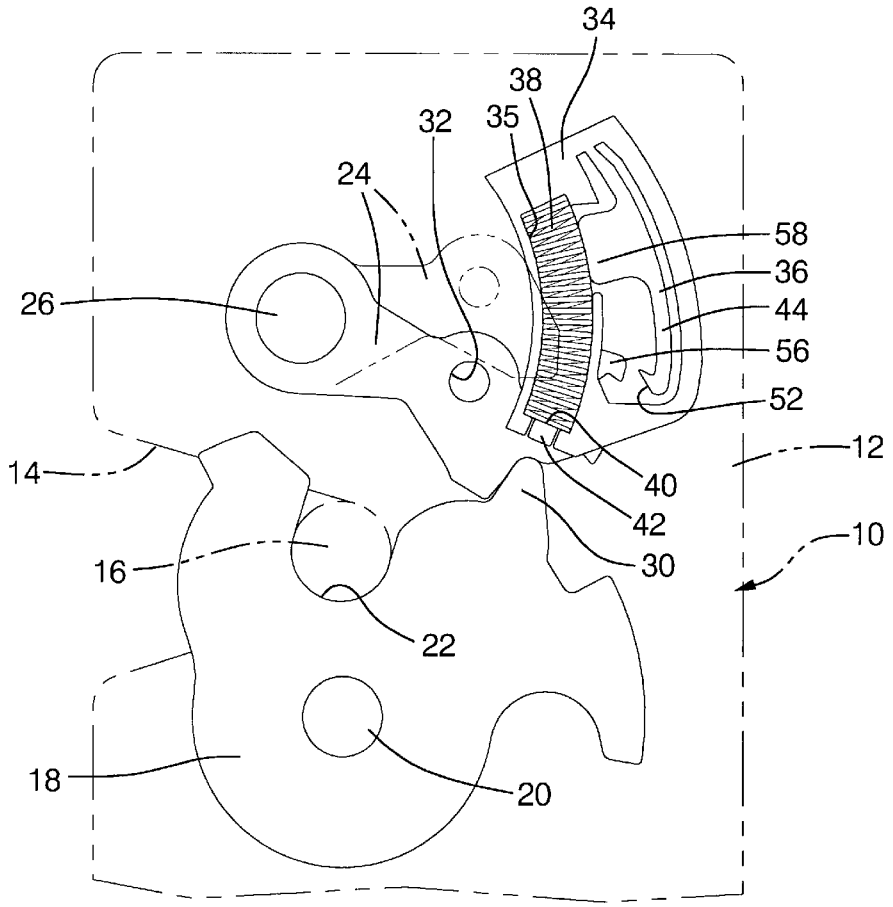
FIG. 1 is a side elevation view of a door latch according to the invention showing the presence of the detent lever spring and disengagement of the catch member from the detent lever.

Referring to FIG. 1, it is seen that the door latch generally indicated as 10 includes a housing 12 having a conventional fish mouth opening 14 for receiving a phantom line indicated striker pin 16 on the vehicle body. A fork bolt 18 is pivotally mounted on the latch housing 12 by pivot 20 and includes a throat 22 which receives and captures the striker pin 16.

A detent lever 24 is pivotally mounted on the housing by a pivot 26 and has a detent tooth 28 which is engageable with a primary latch tooth 30 of the fork bolt 18 to latch the fork bolt 18 in its latched position, shown in FIG. 1.

Figure 2:
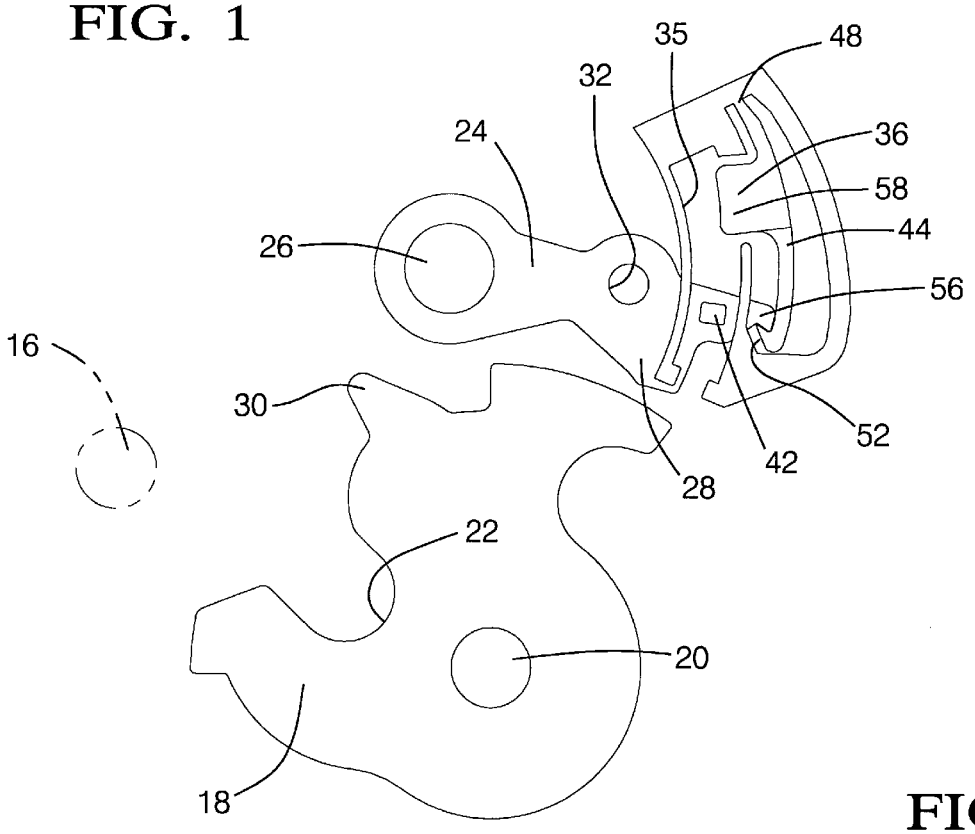
FIG. 2 is a view similar to FIG. 1 but showing the absence of the detent lever spring so that the catch member engages with the detent lever and retains the detent lever in its disengaging position disengaged from the fork bolt.

FIG. 1 also shows detent lever 24 moved to a phantom line indicated disengaged position in which the detent lever 24 is lifted counterclockwise away from engagement with the fork bolt 18 to permit counterclockwise rotation of the fork bolt 18 to the unlatching position of FIG. 2. The detent lever 24 is moved to this disengaged position by a conventional latch operating mechanism, not shown, which connects to the detent lever at aperture 32 of the detent lever.

Referring to FIG. 1, it is seen that a molded plastic housing 34 is suitably mounted on the latch housing 12 and includes an arcuate shaped slot 35 which seats a coil compression spring 38. The lower end 40 of the spring 38 engages a lateral extending abutment 42 of the detent lever 24 so that the detent lever 24 is urged to the engaged position of FIG. 1.

A catch member 36 is provided for establishing the detent lever 24 in the disengaged position in response to an absence of the spring 38. In particular, as seen in FIG. 2, the catch member 36 is a lever 44 integrally molded into the plastic housing 34 and connected thereto at a plastic living hinge 48 which self-biases the catch member 36 to its catching position of FIG. 2 at which a catch hook 52 molded onto the end of the catch member 36 becomes engaged with a complimentary hook portion 56 formed integrally on the end of detent lever 24. The catch member 36 also includes an integrally molded sensing arm 58 which, as seen in FIG. 2, projects into the arcuate slot 35 to thereby sense the presence or absence of the spring 38. As seen in FIG. 2, the absence of the spring 38 permits the catch member 36 to be self-biased to its position of FIG. 2 in which the hook 52 of the catch 36 catches the hook portion 56 of the detent lever 24 upon the first pivoting of the detent lever 24 to its disengaging position.

FIG. 1 shows that the spring 38 is normally engaged by the sensing arm 56 of the catch member 36 so that the catch member 36 is forcibly held at its position of FIG. 1 in which the latch hook 52 thereof is held clear of potential engagement with the hook portion 56 of the detent lever 24.

Thus, it is seen that the catch member 36 of this invention serves to sense the absence of the detent bias spring 38 and retain the detent lever 24 in its position disengaged from the fork bolt 18 and block pivoting of the detent member 24 to the position engaging the fork bolt 18 in response to the absence of spring 38.

As seen in FIG. 2, it will be understood that the capture of the detent lever 24 at the disengaged position of FIG. 2 will prevent the detent lever 24 from engaging with the fork bolt 18 so that the door will remain unlatched to signal absence of the spring.

We claim:

1. A door latch for latching a vehicle door in the closed position, comprising:

a fork bolt pivoting between a latching position and an unlatching position;

a detent lever pivoting between an engaging position engaging with the fork bolt and a disengaging position disengaged from the fork bolt;

a spring acting on the detent lever urging the detent lever to the engaged position;

and a catch member pivoted for movement between a catching position engaging the detent lever to block and a releasing position disengaged from the detent lever to permit movement of the detent lever into engagement with the fork bolt, and the catch member having a sensing arm extending into contact with the spring so that the presence of the spring establishes the catch member at the releasing position and the absence of the spring establishes the catch member at the catching position.

2. The door latch of claim 1 further comprising a plastic housing carried by the door latch and having the spring housed therein and the catch member and said sensing arm being integrally molded with the plastic housing; said sensing arm normally engaging with the spring to establish the catch member in the releasing position and said catch member being biased into sensing contact with the spring so that the absence of the spring enables the catch member to move to the catching position engaging the detent lever.

* * * * *